US010199770B2

(12) United States Patent
Komoto et al.

(10) Patent No.: US 10,199,770 B2
(45) Date of Patent: Feb. 5, 2019

(54) CONNECTOR

(71) Applicant: Japan Aviation Electronics Industry, Limited, Tokyo (JP)

(72) Inventors: Tetsuya Komoto, Tokyo (JP); Akihiro Matsunaga, Tokyo (JP); Seiya Matsuo, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 15/827,656

(22) Filed: Nov. 30, 2017

(65) Prior Publication Data

US 2018/0233854 A1 Aug. 16, 2018

(30) Foreign Application Priority Data

Feb. 10, 2017 (JP) ..... 2017-022827

(51) Int. Cl.

| | |
|---|---|
| ***H01R 12/62*** | (2011.01) |
| ***H01R 13/629*** | (2006.01) |
| ***H01R 12/77*** | (2011.01) |
| ***H01R 12/58*** | (2011.01) |
| ***H01R 13/74*** | (2006.01) |
| ***H01R 12/69*** | (2011.01) |

(Continued)

(52) U.S. Cl.

CPC ..... *H01R 13/629* (2013.01); *H01R 12/58* (2013.01); *H01R 12/69* (2013.01); *H01R 12/777* (2013.01); *H01R 13/74* (2013.01); *H01R 13/436* (2013.01); *H01R 13/514* (2013.01)

(58) Field of Classification Search

CPC ..... H01R 4/5066; H05K 3/301
USPC ..... 439/77, 496, 692, 656
See application file for complete search history.

(56) References Cited

U.S. PATENT DOCUMENTS 1,551,876 A * 9/1925 Hartmann ..... H01R 24/76 439/366
2,277,161 A * 3/1942 Sickinger ..... H01R 24/28 439/459

(Continued)

FOREIGN PATENT DOCUMENTS

EP 2913897 A1 9/2015
JP 06-188058 A 7/1994

(Continued)

*Primary Examiner* — Neil Abrams
(74) *Attorney, Agent, or Firm* — Muncy, Geissler, Olds & Lowe, P.C.

(57) ABSTRACT

A connector includes a base member having a first surface facing a rear surface of a flexible substrate and a projection projecting from the first surface, and a contact which has a second surface facing a flexible conductor exposed on a front surface of the flexible substrate and a projection accommodating portion disposed in the second surface, the first surface of the base member coming into contact with the rear surface of the flexible substrate and the second surface of the contact coming into contact with the front surface of the flexible substrate, the projection being inserted into the projection accommodating portion with the flexible substrate being sandwiched therebetween, and an inner peripheral surface of the projection accommodating portion coming into contact with the flexible conductor in a direction parallel to the second surface to electrically connect the contact to the flexible conductor.

10 Claims, 8 Drawing Sheets

(51) Int. Cl.
*H01R 13/436* (2006.01)
*H01R 13/514* (2006.01)

(56) References Cited

U.S. PATENT DOCUMENTS 2,466,930 A * 4/1949 Cook ..... H01R 4/5008 24/122.6
3,179,916 A * 4/1965 Larson ..... H01H 15/06 292/145
3,249,908 A * 5/1966 Fuller ..... H01R 4/2491 174/261
3,425,027 A * 1/1969 Uberbacher ..... H01K 1/46 313/318.05
3,540,135 A * 11/1970 Alcosser ..... G09B 23/02 434/118
3,611,269 A * 10/1971 Reed ..... H05K 7/1023 439/526
3,701,964 A * 10/1972 Cronin ..... H01R 12/774 174/261
3,805,117 A * 4/1974 Hausman ..... H01L 25/165 257/E25.031
3,961,228 A * 6/1976 Briggs ..... H05K 1/142 361/803
4,186,983 A * 2/1980 Kaye ..... H01M 2/20 439/350
4,202,595 A * 5/1980 Inouye ..... H01R 12/592 439/493
4,316,050 A * 2/1982 Bergmark ..... H01R 4/66 174/7
4,478,475 A * 10/1984 Tullin ..... H01R 4/2491 29/857
4,480,888 A * 11/1984 Hopkins ..... H01R 12/82 439/263
4,586,768 A * 5/1986 Eck ..... H01R 43/26 439/160
4,736,266 A * 4/1988 Tanibe ..... H04M 1/0277 361/792
5,567,167 A * 10/1996 Hayashi ..... H01R 12/52 439/65
6,012,955 A * 1/2000 Shinchi ..... B23K 20/129 439/656
6,616,461 B2 * 9/2003 Bellinghausen ..... H05K 3/301 439/68
6,626,698 B2 * 9/2003 Matsumura ..... H01R 12/775 439/496
6,791,170 B1 * 9/2004 Fuku ..... H05K 7/1417 257/678
7,156,689 B2 * 1/2007 Fabian ..... H01R 4/2433 439/417
7,722,362 B2 * 5/2010 Frake ..... B29C 43/18 439/76.1
7,841,861 B2 * 11/2010 Jung ..... G11B 17/0282 439/631
7,896,688 B2 * 3/2011 Sukegawa ..... H01R 13/447 439/494
8,622,753 B2 * 1/2014 Balzano ..... H01R 13/22 439/225
8,708,712 B2 * 4/2014 Iida ..... H01R 12/79 439/67
9,007,783 B2 * 4/2015 Bolanowski ..... H05K 7/1069 361/785
9,466,905 B2 * 10/2016 Mizoguchi ..... H01R 12/79
2009/0208168 A1 * 8/2009 Ishikawa ..... H01R 13/113 385/14
2009/0239396 A1 * 9/2009 Tay ..... H01R 4/28 439/66

FOREIGN PATENT DOCUMENTS

JP 2005-122901 A 12/2005
JP 2014-203815 A 10/2014

* cited by examiner

CONNECTOR

BACKGROUND OF THE INVENTION

The present invention relates to a connector, particularly to a connector mounted on a flexible substrate having a flexible conductor exposed on a surface thereof.

As a connector mounted on a flexible substrate, for example, JP 2005-122901 A discloses a connector 1 as shown in FIG. 19. The connector 1 is mounted on a flexible flat cable 2 and includes a metal plate 4 having a piercing piece 3, and a metallic receiving groove plate 6 in which a receiving groove 5 is formed.

When the piercing piece 3 of the metal plate 4 is stuck into the flat cable 2 in a state where the metal plate 4 is aligned with the receiving groove plate 6 so that the piercing piece 3 is inserted along one end of the receiving groove 5, a flexible conductor 7 inside the flat cable 2 is sheared by the piercing piece 3. Then, with insertion of the piercing piece 3, a sheared part of the flexible conductor 7 is caught in a gap formed between the other end of the receiving groove 5 and the piercing piece 3 so as to be a stretched, cut part 7A, which comes into contact with the piercing piece 3. As a result, the metal plate 4 and the flexible conductor 7 are electrically connected to each other.

However, the flexible conductor 7 is covered with an insulating material 8 of the flat cable 2 that is to be sheared along with the flexible conductor 7 when the flat cable 2 is pierced with the piercing piece 3 of the metal plate 4. Thus, a cut piece of the insulating material 8 may be sandwiched between the piercing piece 3 and the flexible conductor 7, resulting in poor contact between the piercing piece 3 and the stretched, cut part 7A of the flexible conductor 7. When such poor contact occurs, reliability of the electrical connection between the metal plate 4 and the flexible conductor 7 deteriorates.

In addition, as shown in FIG. 19, the piercing piece 3 needs to be stuck into the flat cable 2 in the state where the metal plate 4 is aligned with the receiving groove plate 6 so that the piercing piece 3 is inserted along one end of the receiving groove 5. Further, a large force is required for sticking the piercing piece 3 into the flat cable 2 in which the flexible conductor 7 is incorporated. Therefore, the connector 1 is hardly mounted on the flat cable 2 in an easy manner.

SUMMARY OF THE INVENTION

The present invention has been made in order to solve the conventional problems described above and an object of the present invention is to provide a connector that has an improved reliability of electrical connection to a flexible conductor of a flexible substrate and can be easily mounted on the flexible substrate.

A connector according to the present invention is adapted to be mounted on a flexible substrate having a front surface and a rear surface opposite with each other and having a flexible conductor exposed on the front surface, the connector comprising:

a base member having a first surface facing the rear surface of the flexible substrate and a projection formed to project from the first surface; and a contact which is made of a conductive material and has a second surface facing the flexible conductor exposed on the front surface of the flexible substrate, and a projection accommodating portion in recess form disposed in the second surface, wherein the first surface of the base member comes into contact with the rear surface of the flexible substrate and the second surface of the contact comes into contact with the front surface of the flexible substrate, the contact is fixed to the base member in a state where the projection of the base member is inserted into the projection accommodating portion of the contact with the flexible substrate being sandwiched therebetween so that the projection of the base member is covered by the flexible substrate, and an inner peripheral surface of the projection accommodating portion comes into contact with the flexible conductor of the flexible substrate in a direction parallel to the second surface to electrically connect the contact to the flexible conductor.

DETAILED DESCRIPTION OF THE INVENTION

Embodiments of the present invention are described below based on the appended drawings.

Embodiment 1

Figure 1:
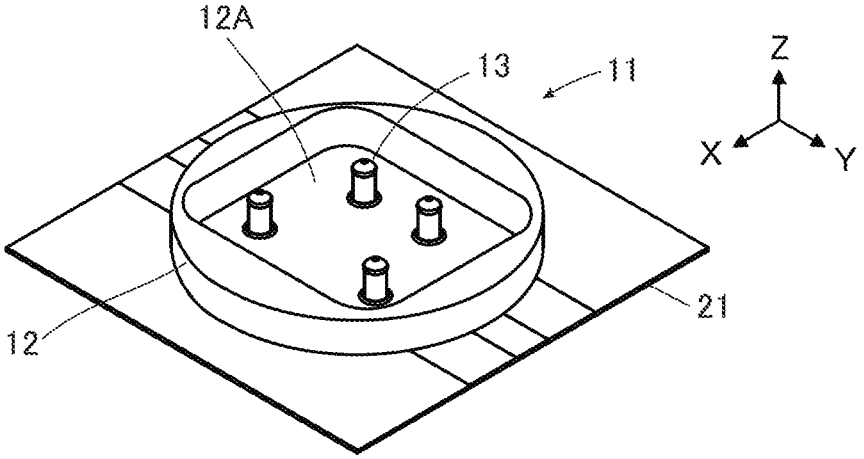
FIG. 1 is a perspective view showing a connector according to Embodiment 1 of the present invention.
Figure 2:
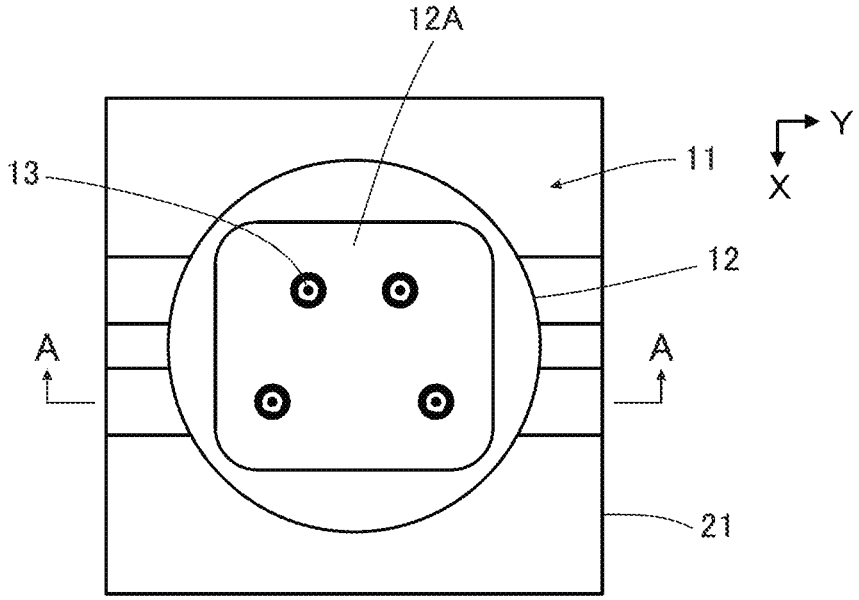
FIG. 2 is a plan view showing the connector according to Embodiment 1.

FIGS. 1 and 2 illustrate a connector 11 according to Embodiment 1. The connector 11 is used as, for example, a garment-side connector portion for fitting a wearable device, and is mounted on a flexible substrate 21.

The connector 11 includes a housing 12 disposed on the flexible substrate 21, and four contacts 13. The housing 12 has a recess 12A within which each of the four contacts 13 projects perpendicularly to the flexible substrate 21.

For convenience, it is assumed that the flexible substrate 21 extends in an XY plane, and a direction in which the contacts 13 each project is referred to as +Z direction.

Figure 3:
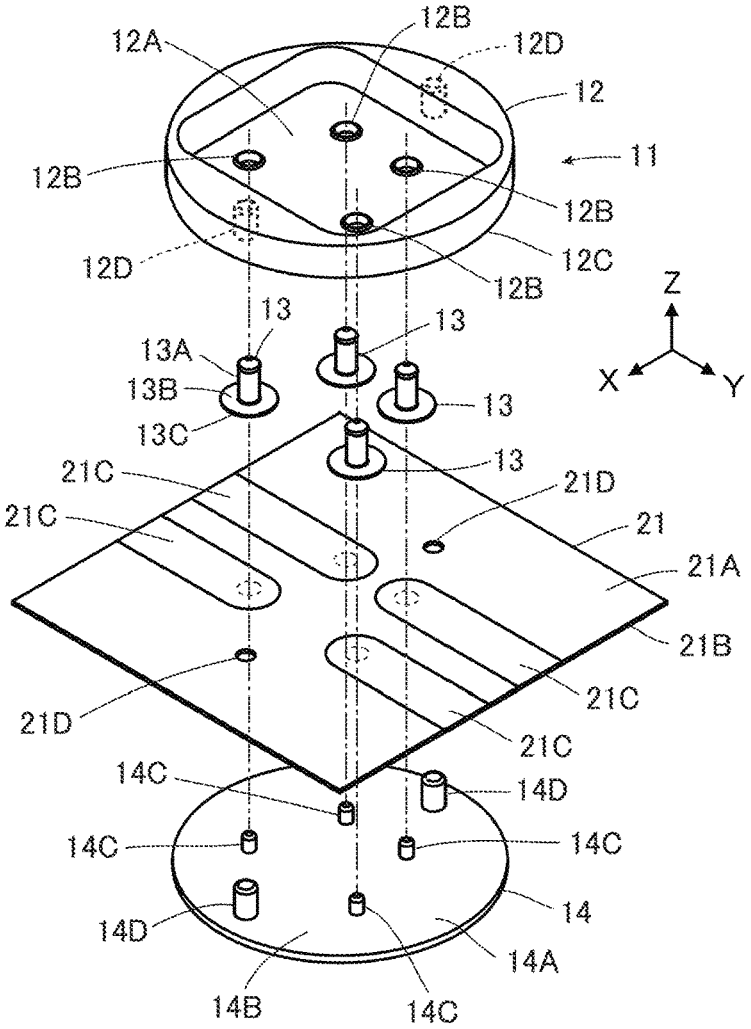
FIG. 3 is an exploded perspective view of the connector according to Embodiment 1.

As shown in FIG. 3, the connector 11 further includes a base member 14 disposed on the −Z direction side of the flexible substrate 21, and is mounted on the flexible substrate 21 with the flexible substrate 21 being sandwiched between the housing 12 and the base member 14.

The flexible substrate 21 has a front surface 21A facing in the +Z direction, and a rear surface 21B facing in the −Z direction, and four flexible conductors 21C are formed in a state of being exposed on the front surface 21A. The four flexible conductors 21C correspond to the four contacts 13, respectively.

Further, two through-holes 21D are formed in the flexible substrate 21.

The housing 12 is made of an insulating material such as an insulating resin, and four through-holes 12B for contacts are formed in the recess 12A opening in the +Z direction. The four through-holes 12B for contacts respectively correspond to the four contacts 13. In the region of a surface 12C of the housing 12 on the −Z direction side that is located outside the recess 12A in the X and Y directions, two post accommodating portions 12D in recess form are formed.

Each of the four contacts 13 is a plug-type contact made of a conductive material such as metal, and has a tubular portion 13A having a cylindrical shape extending in the Z direction and a flange 13B extending from a −Z direction end of the tubular portion 13A along the XY plane. The flange 13B has a second surface 13C facing in the −Z direction.

The base member 14 is made of an insulating material such as an insulating resin and has a flat plate part 14A. The flat plate part 14A has a first surface 14B facing in the +Z direction, and four projections 14C are formed to project from the first surface 14B. Further, two housing fixing posts 14D, each of which has a height larger than that of the projection 14C, are formed to project from the first surface 14B of the flat plate part 14A.

As shown in FIG. 3, the four through-holes 12B for contacts of the housing 12, the four flexible conductors 21C of the flexible substrate 21, and the four projections 14C of the base member 14 are disposed at positions corresponding to each other.

Similarly, the two post accommodating portions 12D of the housing 12, the two through-holes 21D of the flexible substrate 21, and the two housing fixing posts 14D of the base member 14 are disposed at positions corresponding to each other.

Each of the through-holes 21D of the flexible substrate 21 is configured to have an inner diameter slightly larger than an outer diameter of each of the housing fixing posts 14D of the base member 14 so that the housing fixing posts 14D can be respectively smoothly inserted into the through-holes 21D. Further, each of the post accommodating portions 12D of the housing 12 is configured to have an inner diameter slightly smaller than the outer diameter of each of the housing fixing posts 14D of the base member 14 so that the housing 12 and the base member 14 are fixed to each other by respectively press-fitting the housing fixing posts 14D into the post accommodating portions 12D.

Further, each of the through-holes 12B for contacts of the housing 12 is configured to have an inner diameter larger than an outer diameter of each of the tubular portions 13A of the contacts 13 but smaller than an outer diameter of each of the flanges 13B so that the tubular portions 13A of the contacts 13 can be respectively smoothly inserted into the through-holes 12B for contacts.

Figure 4:
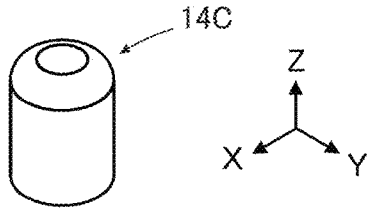
FIG. 4 is a perspective view showing a projection used in the connector according to Embodiment 1.

As shown in FIG. 4, the projection 14C of the base member 14 has a columnar shape extending in the Z direction.

Figure 5:
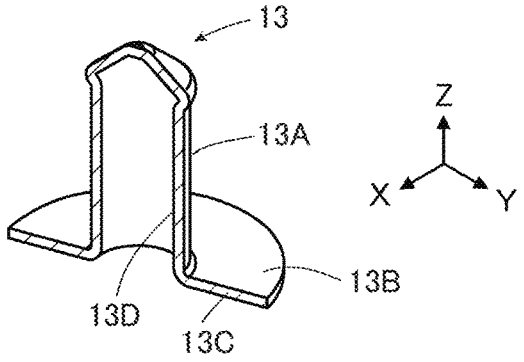
FIG. 5 is a perspective cross-sectional view showing a contact used in the connector according to Embodiment 1.

As shown in FIG. 5, the tubular portion 13A of the contact 13 has a cylindrical shape with a +Z directional end closed, the flange 13B is formed integrally with a −Z directional end of the tubular portion 13A, and a projection accommodating portion 13D in recess form is disposed in the second surface 13C of the flange 13 facing in the −Z direction. Specifically, the projection accommodating portion 13D is formed within the tubular portion 13A so as to have an opening end at the second surface 13C of the flange 13B.

The projection accommodating portion 13D of the contact 13 has an inner diameter whose value is smaller than a value obtained by adding a double of a sum of a thickness of the flexible substrate 21 at a part where the flexible conductor 21C is exposed and a thickness of the flexible conductor 21C to an outer diameter of the projection 14C of the base member 14. Such contact 13 can be produced by, for example, pressing a metal plate.

For mounting the connector 11 on the flexible substrate 21, first, in FIG. 3, the two housing fixing posts 14D of the base member 14 are respectively inserted into the two through-holes 21D so as to project above the front surface 21A of the flexible substrate 21, the four tubular portions 13A of the contacts 13 are respectively inserted from the −Z direction side into the four through-holes 12B for contacts of the housing 12, and the two tips of the housing fixing posts 14D of the base member 14, each of which projects above the front surface 21A of the flexible substrate 21, are respectively inserted into the two post accommodating portions 12D of the housing 12. As a result, the housing 12, the four contacts 13, the flexible substrate 21, and the base member 14 are aligned with each other in the X and Y directions.

Since each of the housing fixing posts 14D of the base member 14 has a height larger than that of each of the projections 14C, the housing fixing posts 14D are respectively inserted into the through-holes 21D of the flexible substrate 21 without being affected by existence of the projections 14C.

When the housing 12 and the base member 14 are pressed against each other in the Z direction so as to be in proximity to each other in this state, the surface 12C of the housing 12 on the −Z direction side and the second surfaces 13C of the four contacts 13 facing in the −Z direction come into contact with the front surface 21A of the flexible substrate 21, and the four projections 14C of the base member 14 come into contact with the rear surface 21B of the flexible substrate 21, and the contacted parts of the flexible substrate 21 are pressed in the +Z direction.

Figure 6:
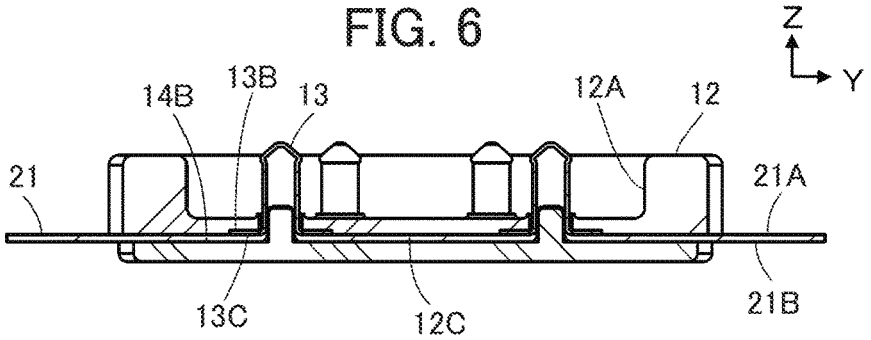
FIG. 6 is a cross-sectional view taken along line A-A in FIG. 2.

As a result, as shown in FIG. 6, each of the projections 14C of the base member 14 is inserted into the corresponding projection accommodating portion 13D of the contact 13 with the flexible substrate 21 being sandwiched therebetween, so that the first surface 14B of the base member 14 facing in the +Z direction is in contact with the rear surface 21B of the flexible substrate 21.

At this time, since each of the through-holes 12B for contacts of the housing 12 has an inner diameter larger than the outer diameter of each of the tubular portions 13A of the contacts 13 and smaller than the outer diameter of each of the flanges 13B, each of the flanges 13B of the contacts 13 is sandwiched between the surface 12C of the housing 12 on the −Z direction side and the front surface 21A of the flexible substrate 21, so that the contacts 13 are fixed to the base member 14. Further, the housing 12 and the base member 14 are fixed to each other by respectively press-fitting the two housing fixing posts 14D of the base member 14 into the two post accommodating portions 12D of the housing 12, so that the mounting of the connector 11 on the flexible substrate 21 is completed.

Figure 7:
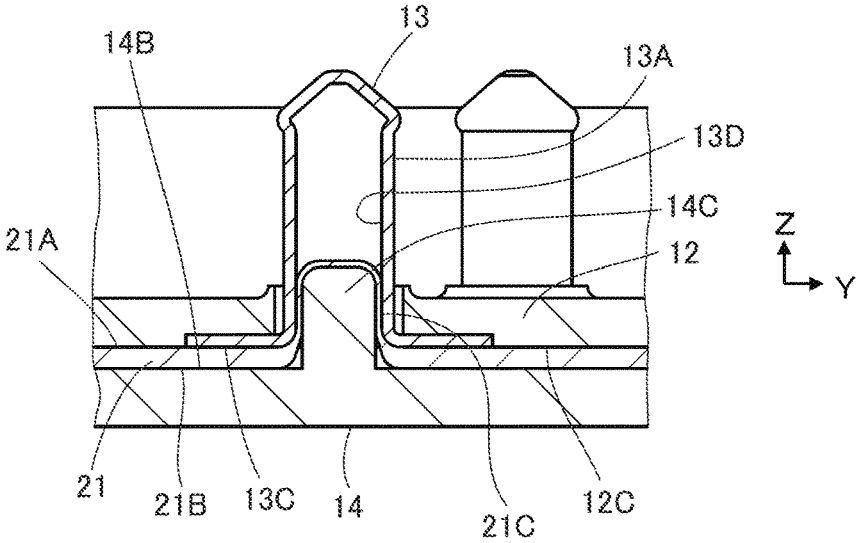
FIG. 7 is an enlarged view of a main part of FIG. 6.

When the connector 11 is mounted on the flexible substrate 21 in this manner, as shown in FIG. 7, the whole surface of the projection 14C of the base member 14 is inserted into the projection accommodating portion 13D of the contact 13 in a state of being covered by the flexible substrate 21. Thus, the flexible substrate 21 and the flexible conductor 21C exposed on the front surface 21A thereof are projected and deformed in the Z direction toward the projection accommodating portion 13D by the projection 14C, and the inner peripheral surface of the projection accommodating portion 13D of the contact 13 comes into contact with the flexible conductor 21C in a direction parallel to the second surface 13C of the contact 13, that is, in a direction along the XY plane. At this time, since the projection accommodating portion 13D of the contact 13 has an inner diameter whose value is smaller than a value obtained by adding a double of a sum of a thickness of the flexible substrate 21 at a part where the flexible conductor 21C is exposed and a thickness of the flexible conductor 21C to the outer diameter of the projection 14C of the base member 14, the flexible conductor 21C is pressed against the inner peripheral surface of the projection accommodating portion 13D of the contact 13 by the projection 14C so that a contact pressure is applied thereto, whereby the contact 13 is electrically connected to the flexible conductor 21C.

Here, when the flexible substrate 21 is made of an elastically stretchable material, as shown in FIG. 7, the flexible substrate 21 is stretched so as to cover the projection 14C of the base member 14 in a state where the thickness of the flexible substrate 21 becomes slightly small. Thus, in order that the flexible substrate 21 is not sheared by being pressed by the projection 14C, the height and the like of the projection 14C are set in advance. Therefore, a cut piece of the flexible substrate 21 is not generated, so that the contact 13 can be surely electrically connected to the flexible conductor 21C of the flexible substrate 21.

Further, it is possible to easily mount the connector 11 on the flexible substrate 21 simply by respectively inserting the projections 14C of the base member 14 into the projection accommodating portions 13D of the contacts 13 with the flexible substrate 21 being sandwiched therebetween.

Further, since the base member 14 includes the two housing fixing posts 14D each of which has a height larger than that of each of the projections 14C of the base member 14, the housing 12, the four contacts 13, the flexible substrate 21 and the base member 14 are aligned with each other in the X and Y directions by respectively inserting the housing fixing posts 14D into the two through-holes 21D of the flexible substrate 21 and the two post accommodating portions 12D of the housing 12, thereby further facilitating the mounting work of the connector 11 on the flexible substrate 21.

Although the four contacts 13 are used, the connector may have one or more contacts 13. However, regardless of the number of the contacts 13, all of the contacts 13 can be simultaneously fitted into the corresponding projections 14C of the base member 14 by pressing the housing 12 and the base member 14 with each other so that they are in close proximity to each other with the flexible substrate 21 being sandwiched therebetween. Therefore, even if the connector 11 is a multi-contact connector having a plurality of contacts 13, it is possible to achieve easy mounting and sure electrical connection.

Further, the housing 12 and the base member 14 are mutually fixed by respectively press-fitting the housing fixing posts 14D of the base member 14 into the post accommodating portions 12D of the housing 12, but this assembling technique is merely an example and the invention is not limited thereto. For example, the housing 12 can be fixed to the base member 14 by other methods using screws or adhesives.

Since the base member 14 is not in direct contact with the contacts 13 and the flexible conductors 21C of the flexible substrate 21, the base member 14 can also be made of a conductive material such as metal instead of an insulating material.

Figure 8:
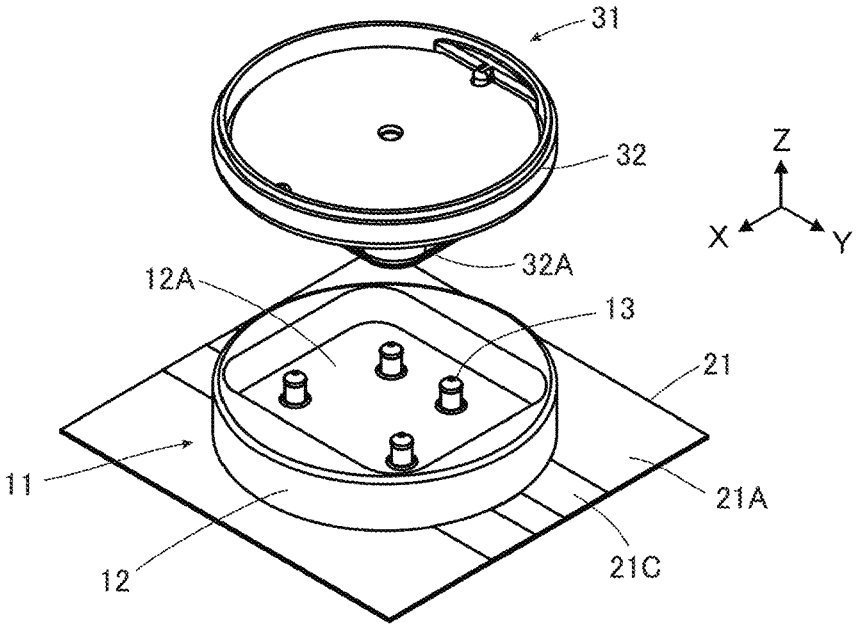
FIG. 8 is a perspective view showing the connector according to Embodiment 1 and a counter connector before fitting as viewed from obliquely above.
Figure 9:
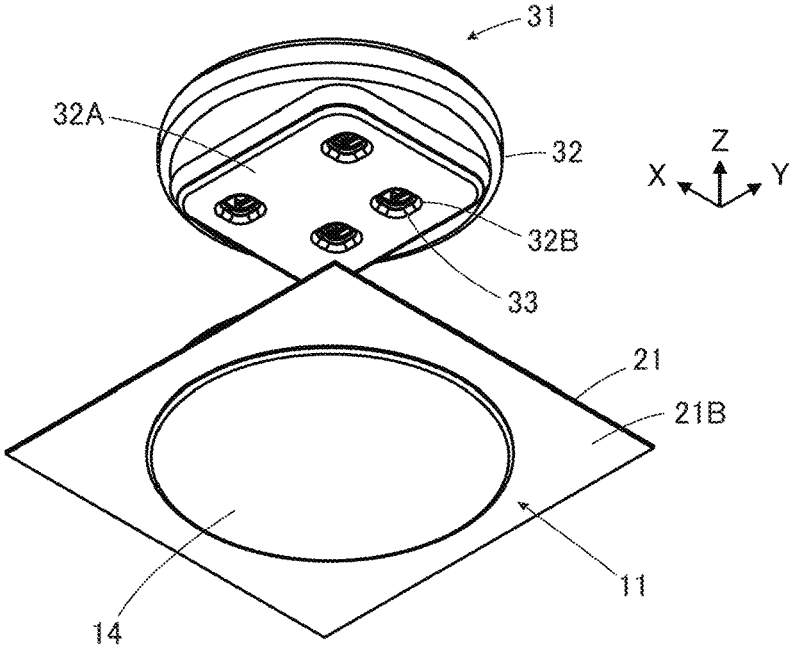
FIG. 9 is a perspective view showing the connector according to Embodiment 1 and the counter connector before fitting as viewed from obliquely below.

FIGS. 8 and 9 illustrate a state where the connector 11 mounted on the flexible substrate 21 is aligned with an electronic apparatus module 31 which is to be a counter connector.

The electronic apparatus module 31 has a housing 32 made of an insulating material such as an insulating resin, and four contacts 33 disposed inside the housing 32. Each of these contacts 33 is a contact having a spring contact point.

Figure 10:
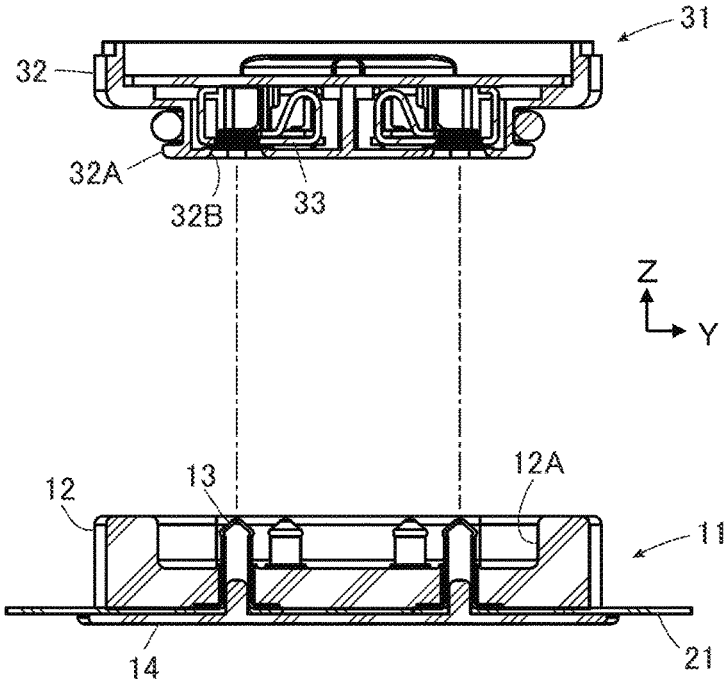
FIG. 10 is a cross-sectional view showing the connector according to Embodiment 1 and the counter connector before fitting.
Figure 11:
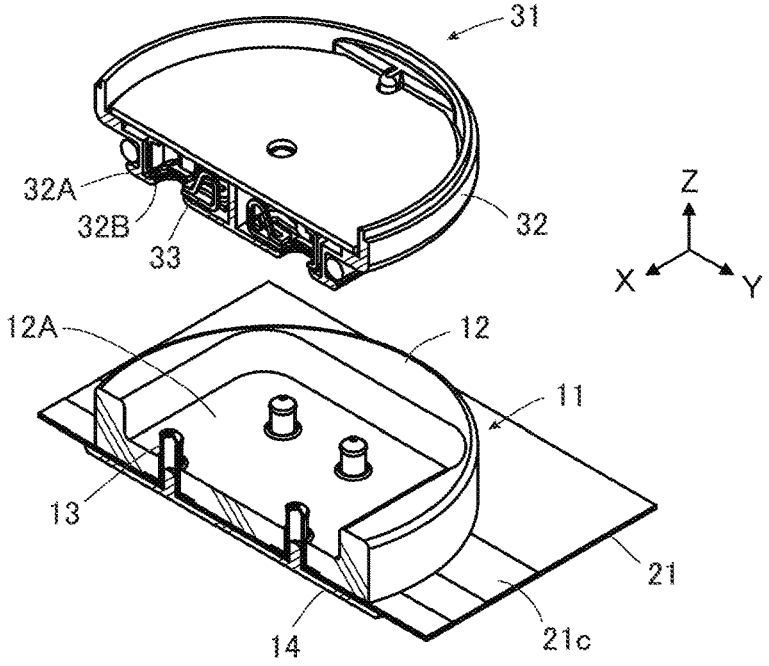
FIG. 11 is a perspective cross-sectional view showing the connector according to Embodiment 1 and the counter connector before fitting as viewed from obliquely above.

The housing 32 has a protrusion 32A projecting in the −Z direction, and four openings 32B respectively corresponding to the four contacts 33 are formed in the protrusion 32A. As shown in FIGS. 10 and 11, each of the four contacts 33 is exposed through the corresponding opening 32B of the housing 32.

The protrusion 32A and the four contacts 33 of the housing 32 are respectively arranged at positions corresponding to the recess 12A of the housing 12 and the four contacts 13 of the connector 11 on the XY plane, and the protrusion 32A of the housing 32 has a shape and a size capable of being inserted into the recess 12A of the housing 12 of the connector 11.

By fitting such electronic apparatus module 31 into the connector 11, each of the four contacts 13 of the connector 11 is electrically connected to the corresponding contact 33 of the electronic apparatus module 31.

If the connector 11 is configured as the garment-side connector portion attached to a garment, the electronic apparatus module 31 can be used as a wearable device connected to the garment-side connector portion.

Embodiment 2

Figure 12:
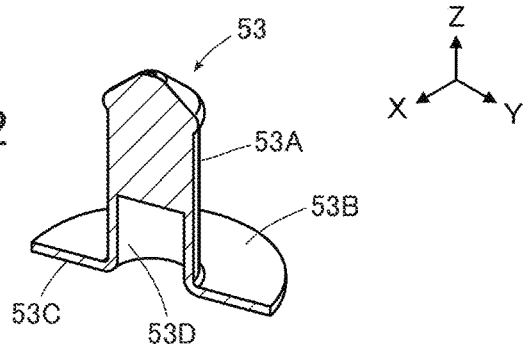
FIG. 12 is a perspective cross-sectional view showing a contact used in a connector according to Embodiment 2.

The contact 13 used in the connector 11 of Embodiment 1 is made up of a plate material as shown in FIG. 5, and is produced by, for example, pressing, but the invention is not limited thereto. For example, as shown in FIG. 12, a contact 53 produced by, for example, metal casting, metal forging, cold forging of metal or metal cutting can be used.

As with the connector 11 of Embodiment 1, the contact 53 has a tubular portion 53A having a cylindrical shape extending in the Z direction, and a flange 53B extending from the −Z direction end of the tubular portion 53A along the XY plane, and the flange 53B has a second surface 53C facing in the −Z direction. Further, a projection accommodating portion 53D in recess form is formed within the tubular portion 53A so as to have an opening end on the second surface 53C of the flange 53B.

Even if such contact 53 is used, as with Embodiment 1, a connector capable of being surely electrically connected to the flexible conductor 21C of the flexible substrate 21 and being readily mounted on the flexible substrate 21 can be achieved.

Embodiment 3

In the above-described Embodiment 1, the contacts 13 are fixed to the base member 14 by sandwiching the flanges 13B of the contacts 13 between the surface 12C of the housing 12 on the −Z direction side and the front surface 21A of the flexible substrate 21, but the invention is not limited thereto.

Figure 13:
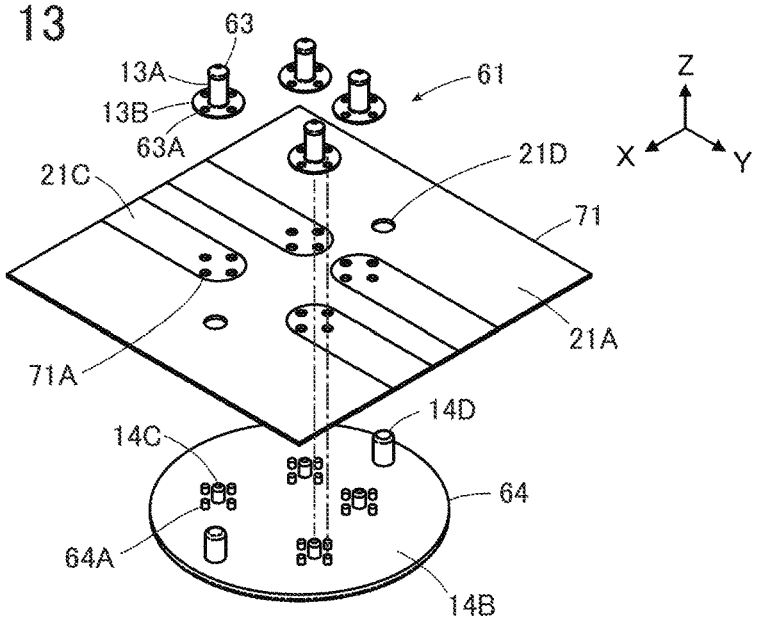
FIG. 13 is an exploded perspective view of a connector according to Embodiment 3.

FIG. 13 shows an exploded perspective view of a connector 61 according to Embodiment 3.

The connector 61 is mounted on a flexible substrate 71 and includes four contacts 63 and a base member 64 disposed on the −Z direction side of the flexible substrate 71.

Each of the four contacts 63 is configured by forming four through-holes 63A for protrusions in each of the flanges 13B of the contacts 13 in Embodiment 1 shown in FIG. 3, so that the contacts 63 have the same configuration as that of the contacts 13 other than such through-holes 63A for protrusions. The four through-holes 63A for protrusions are disposed around the relevant tubular portion 13A so as to surround the tubular portion 13A.

While the base member 64 is configured by forming and projecting four contact fixing protrusions 64A in close proximity to each of the projections 14C on the first surface 14B facing in the +Z direction in the base member 14 of Embodiment 1 shown in FIG. 3, the base member 64 has the same configuration as that of the base member 14 other than these contact fixing protrusions 64A. The four contact fixing protrusions 64A are disposed around the corresponding projection 14C so as to surround the projection 14C and each of the four contact fixing protrusions 64A has a height smaller than that of each of the projections 14C.

Further, while the flexible substrate 71 is configured by forming four through-holes 71A around each of positions corresponding to the four projections 14C of the base member 64 in the flexible substrate 21 used in Embodiment 1 shown in FIG. 3, the flexible substrate 71 has the same configuration as that of the flexible substrate 21 other than these through-holes 71A. The four through-holes 71A are formed through the corresponding flexible conductor 21C.

The four through-holes 63A for protrusions formed in each of the contacts 63, the four contact fixing protrusions 64A formed around each of the projections 14C of the base member 64, and the four through-holes 71A formed through each of the flexible conductors 21C of the flexible substrate 71 are disposed at positions corresponding to each other.

For mounting the connector 61 of Embodiment 3 on the flexible substrate 71, first, the housing fixing posts 14D of the base member 64 are respectively inserted into the through-holes 21D of the flexible substrate 71, and then a force in the −Z direction toward the base member 64 is applied to each of the four contacts 63 disposed on the front surface 21A of the flexible substrate 71, so that each of the projections 14C of the base member 64 is inserted into the corresponding projection accommodating portion 13D of the contact 63 with the flexible substrate 71 being sandwiched therebetween.

Figure 14:
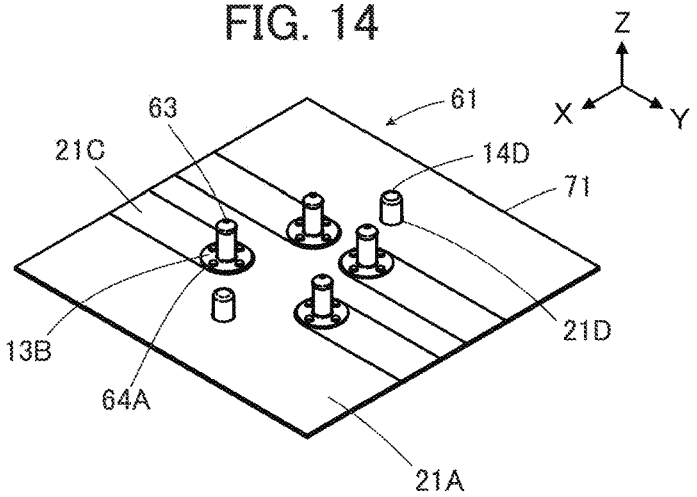
FIG. 14 is a perspective view showing a state where contacts of the connector according to Embodiment 3 are mounted on a flexible substrate.
Figure 15:
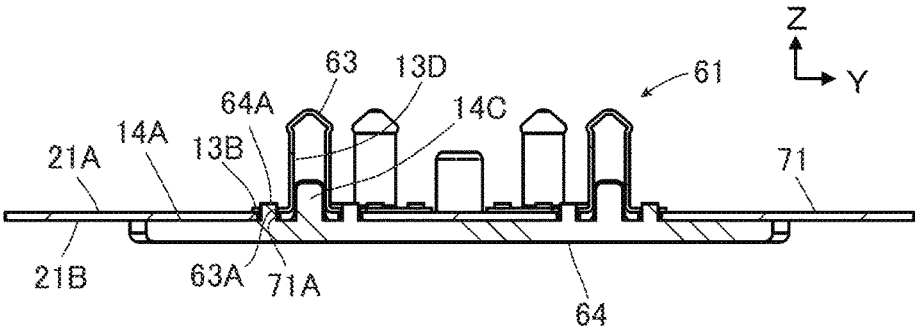
FIG. 15 is a cross-sectional view showing a state where the contacts of the connector according to Embodiment 3 are mounted on the flexible substrate.

At this time, as shown in FIGS. 14 and 15, each of the contact fixing protrusions 64A of the base material 64 penetrates the corresponding through-hole 71A of the flexible substrate 71 and the corresponding through-hole 63A for protrusion of the contacts 63 so as to project from the flange 13B of the contacts 63 in the +Z direction.

Figure 16:
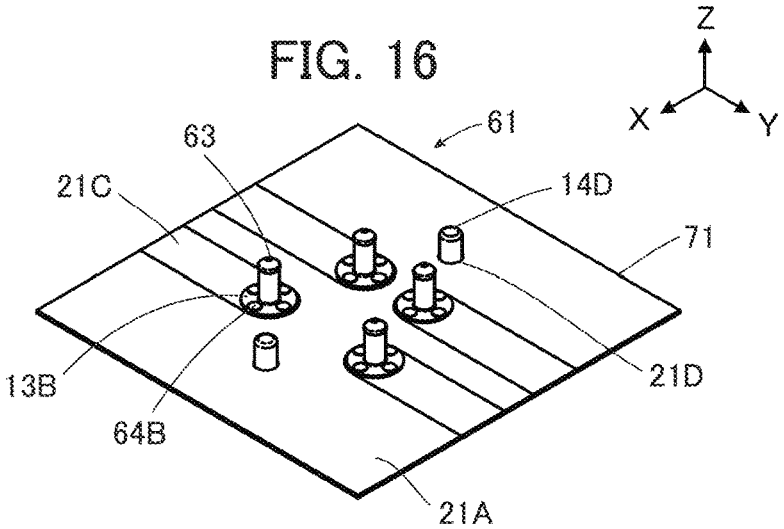
FIG. 16 is a perspective view showing the connector according to Embodiment 3.
Figure 17:
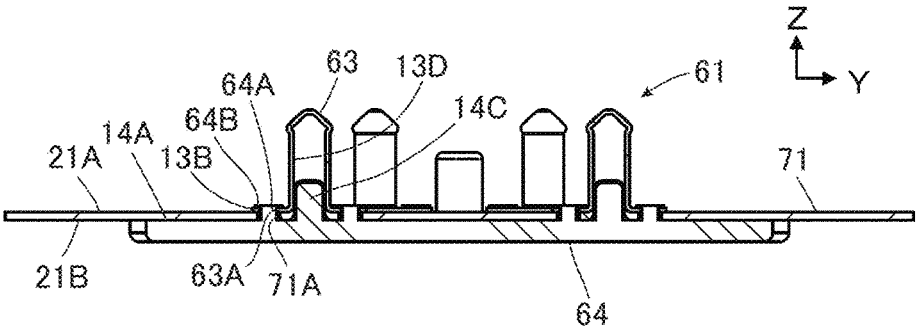
FIG. 17 is a cross-sectional view showing the connector according to Embodiment 3.

As with the base member 14 of Embodiment 1, the base member 64 is made of an insulating material such as an insulating resin. Thus, heads of the contact fixing protrusions 64A of the base member 64 projecting from the flanges 13B of the contacts 63 in the +Z direction are deformed by, for example, heating, thereby forming deformed portions 64B each having an outer diameter larger than the outer diameter of the contact fixing protrusion 64A, as shown in FIGS. 16 and 17. Each of the deformed portions 64B is formed to have an outer diameter larger than an inner diameter of each of the through-holes 63A for protrusions formed in the flange 13B of the contact 63. The contact 63 can be fixed to the base member 64 by forming such deformed portions 64B.

As with Embodiment 1, if the housing 12 is disposed on the front surface 21A side of the flexible substrate 71 and is fixed to the base member 64 using the housing fixing posts 14D of the base member 64, the connector 61 can be configured as the garment-side connector portion for fitting a wearable device. Further, the contact fixing protrusions 64A can be configured as a separate component from the base member 64 instead of being integrated with the base member 64.

Figure 18:
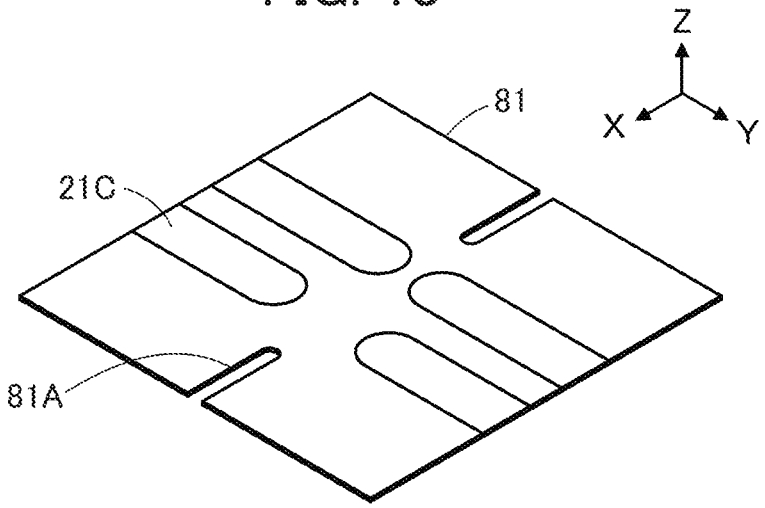
FIG. 18 is a perspective view showing a flexible substrate according to a modification.
Figure 19:
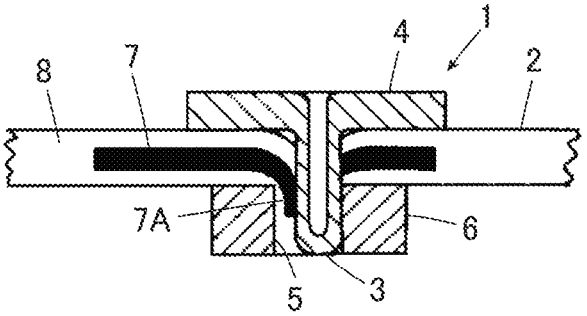
FIG. 19 PRIOR ART
FIG. 19 is a cross-sectional view showing a conventional connector mounted on a flat cable.

While the flexible substrate 21 or 71 used in the above-described Embodiments 1, 2, or 3 is aligned with the base member 14 or 64 by respectively inserting the two housing fixing posts 14D of the base member 14 or 64 into the two through-holes 21D, the invention is not limited thereto. For example, as shown in FIG. 18, a flexible substrate 81 in which two notches are formed may be used. Even such flexible substrate 81 can be aligned with the base member 14 or 64 by respectively inserting the two housing fixing posts 14D of the base member 14 or 64 into the two notches 81A.

While the plug-type contacts 13 and 63 are used in the above-described Embodiments 1 to 3, the invention is not limited thereto, and a connector in which a receptacle-type contact is connected to the flexible conductor 21C of the flexible substrate 21, 71 or 81 can also be configured.

What is claimed is:

1. A connector adapted to be mounted on a flexible substrate having a front surface and a rear surface opposite with each other and having a flexible conductor exposed on the front surface, comprising:

a base member having a first surface facing the rear surface of the flexible substrate and a projection formed to project from the first surface; and a contact which is made of a conductive material and has a second surface facing the flexible conductor exposed on the front surface of the flexible substrate, and a projection accommodating portion in recess form disposed in the second surface, wherein the contact has a tubular portion and a flange formed at one end of the tubular portion, and the second surface is formed by the flange and the projection accommodating portion is formed within the tubular portion so as to open toward the second surface, wherein the first surface of the base member comes into contact with the rear surface of the flexible substrate and the second surface of the contact comes into contact with the front surface of the flexible substrate, the contact is fixed to the base member in a state where the projection of the base member is inserted into the projection accommodating portion of the contact with the flexible substrate being sandwiched therebetween so that the projection of the base member is covered by the flexible substrate, and the flexible conductor of the flexible substrate is pressed against an inner peripheral surface of the projection accommodating portion of the contact by the projection in a direction parallel to the second surface to electrically connect the contact to the flexible conductor.

2. The connector according to claim 1, further comprising a housing in which a through-hole for contact is formed, the through-hole for contact being penetrated by the tubular portion of the contact and being smaller than the flange, wherein the contact is fixed to the base member by allowing the tubular portion of the contact to penetrate the through-hole for contact and fixing the housing to the base member so that the flange is pressed against the first surface of the base member.

3. The connector according to claim 2, wherein the base member has a housing fixing post, the housing fixing post being formed to project from the first surface and being higher than the projection, the housing has a post accommodating portion in recess form, and the housing is fixed to the base member by making the housing fixing post accommodated by the post accommodating portion.

4. The connector according to claim 2, wherein the housing is made of an insulating material.

5. The connector according to claim 2, wherein the housing has a counter connector accommodating portion configured to accommodate part of a counter connector.

6. The connector according to claim 1, wherein the base member has a contact fixing protrusion formed to project from the first surface near the projection, the flange of the contact has a through-hole for protrusion, the through-hole for protrusion being penetrated by the contact fixing protrusion, and the contact is fixed to the base member by deforming a head of the contact fixing protrusion after penetration of the through-hole for protrusion.

7. The connector according to claim 1, wherein the base member is made of an insulating material.

8. The connector according to claim 1, wherein the contact includes a tubular portion of a cylindrical shape, the projection accommodating portion being formed within the tubular portion, the projection has a columnar shape, and the projection accommodating portion has an inner diameter whose value is smaller than a value obtained by adding a double of a sum of a thickness of the flexible substrate at a part where the flexible conductor is exposed and a thickness of the flexible conductor to an outer diameter of the projection.

9. The connector according to claim 1, wherein the contact is a plug-type contact.

10. The connector according to claim 1, wherein the contact is a receptacle-type contact.

* * * * *